United States Patent [19]

Höfer et al.

[11] 4,273,090

[45] Jun. 16, 1981

[54] FUEL INJECTION PUMP

[75] Inventors: Gerald Höfer, Weissach-Flacht; Karl Konrath, Ludwigsburg; Franz Eheim; Otmar Weiss, both of Stuttgart; Edgar Schmitt, Möglingen; Werner Faupel, Gerlingen; Edgar Götz, Stuttgart, all of Fed. Rep. of Germany

[73] Assignee: Robert Bosch GmbH, Stuttgart, Fed. Rep. of Germany

[21] Appl. No.: 844,933

[22] Filed: Oct. 25, 1977

[30] Foreign Application Priority Data

Oct. 23, 1976 [DE] Fed. Rep. of Germany ..... 2648043

[51] Int. Cl.[3] ..... F02M 59/34

[52] U.S. Cl. ..... 123/502; 123/500; 123/506; 123/179 L

[58] Field of Search ..... 123/139 ST, 139 AP, 123/139 AQ, 139 BD, 139 AF, 140 A, 140 FG, 179 L

[56] References Cited

U.S. PATENT DOCUMENTS

| | | | |
|---|---|---|---|
| 2,984,232 | 5/1961 | Arndt et al. | 123/179 L |
| 3,633,559 | 1/1972 | Eheim | 123/139 AQ |
| 3,638,631 | 2/1972 | Eheim | 123/139 ST |
| 3,815,564 | 6/1974 | Suda et al. | 123/139 AP |
| 3,906,916 | 9/1975 | Laufer | 123/139 AQ |
| 4,122,813 | 10/1978 | Barnert et al. | 123/139 AQ |
| 4,132,211 | 1/1979 | Wilfert et al. | 123/179 L |

*Primary Examiner*—Charles J. Myhre
*Assistant Examiner*—Andrew M. Dolinar
*Attorney, Agent, or Firm*—Edwin E. Greigg

[57] ABSTRACT

A fuel injection pump for Diesel engines in which a rotating and reciprocating piston pressurizes and distributes fuel to individual pressure lines leading to the injection valves of the engine. In order to change the timing of injection with respect to the engine cycle, there is provided a mechanism to change the relative angle between the pressurizing piston and its drive means, which runs in synchronism with the engine. The mechanism operates hydraulically and is affected by the fuel pressure in the sump of the injection pump. There is also provided a hydraulic control valve mechanism which permits varying amounts of fuel to flow back from the sump to the low pressure side of the fuel delivery pump, thereby changing the injection timing. A primary control valve adjusts the sump pressure on the basis of engine speed while a secondary control valve adjusts the sump pressure on the basis of engine temperature in order to adapt the timing of fuel injection to engine starting and engine warm-up. Various embodiments are presented.

13 Claims, 13 Drawing Figures

1
2
3
4
5
6
7
8
9
10
11
12
13
14
16
17
18
19
20
21
23
24
25
26
27
28
29
30
31
32
33
34
35
36
38
39
40
41
42
43
44
46
47
49

P
P1
n1
n2
n
I
II
III

FUEL INJECTION PUMP

BACKGROUND OF THE INVENTION

The invention relates to a fuel injection pump for internal combustion engines. More particularly, the invention relates to a fuel injection pump to be used in a Diesel engine and including a simultaneously rotating and reciprocating pressurizing piston. The pump includes a provision for changing the relative angular position of the pump piston and its drive shaft so as to permit a change of the fuel injection timing. The fuel injection pump receives fuel from a fuel supply pump that is constructed to deliver fuel at an rpm-dependent pressure to the injection pump supply sump.

In a known fuel injection pump of this general type, a provision exists for changing the fuel timing to shift the point of injection manually to an advanced position for the purpose of engine starting. This known fuel injection pump includes no automatic injection timing adjustment for the lower load and speed domains in which this manual adjustment takes place. In the higher load and speed domains, the injection timing is substantially load-dependent inasmuch as the link between the speed governor and the injection timer is constituted by linkage coupled to the externally settable engine control lever. One of the disadvantages of this known construction is that the adjustment of the onset of injection is load-dependent and another is that, while injection can be advanced in the lower speed and load domain, it is substantially ineffective in all the other regions.

In another known fuel injection pump, a pressure control valve permits a return of a portion of the fuel delivered by the piston to the sump or to the fuel tank so as to obtain rpm-dependent pressure control. The pump controller also actuates a valve which permits a load-dependent return flow of part of the fuel, thereby causing a load-dependent injection time adjustment. Again it is a serious disadvantage that the engine load is the only engine variable which is used to control the engine to reduce noise, toxic emissions and fuel consumption.

OBJECT AND SUMMARY OF THE INVENTION

It is thus a principal object of the invention to provide a high-pressure fuel injection pump in which the adjustment of the onset of injection depends substantially on engine speed (rpm). It is further object of the invention to provide a high-pressure fuel injection pump in which injection timing is alterable at low engine speeds. A further and major object of the invention is to provide means in a high-pressure fuel injection pump for performing an advance of the injection timing at the start of the engine until such time as the engine has warmed up to normal operating temperatures. The effects of the injection timing control and the basic speed governing control are both independently maintained and can be individually optimized. A distinct advantage of the provisions of the invention is that the two types of control are independently superimposed and thereby are capable of being embodied in any desired manner, beginning with a simple arbitrary setting of the control pressure, up to a fully automated system. Furthermore, the automation may be performed by modules which can be added to the pump at any time, even after manufacture. It is thus possible to use relatively simple means to obtain a multitude of different pumps which, however, all share the basic characteristics of the invention, i.e., that a certain amount of the fuel delivered to the pump is returned to the tank so as to obtain injection advance during engine warm-up via a pressure change of the fuel contained within the sump of the high-pressure pump.

The invention will be better understood as well as further objects and advantages thereof become more apparent from the ensuing detailed description of several preferred embodiments taken in conjunction with the drawing.

DESCRIPTION OF THE PREFERRED EMBODIMENTS

Introductory Considerations

In normal operation of a Diesel engine, fuel is injected at a time when the piston is in the vicinity of its top dead center (TDC). The exact moment of fuel injection may vary from a time shortly prior to TDC until a time shortly after TDC. In general, the higher the engine speed (rpm), the earlier is the fuel injected. The amount of time required for fuel to flow from the injection pump to the injection nozzles is generally independent of the engine speed, whereas the time required for fuel delivery by the pump and for actual combustion in the engine is a definite function of engine speed. This latter time dependence is compensated by a mechanism which changes the point of fuel injection and this task absorbs most of the control range. A further amount of controller capacity may be used to improve fuel consumption, power and decrease the engine noise and/or exhaust gas toxicity. It is well known that the combustion process in a Diesel engine depends on temperature in various ways, for example on fuel temperature as well as engine temperature, in particular cylinder wall temperature. In order to compensate for these various effects, it is advantageous to advance the onset of injection in a cold engine at low rpm. At high engine speed, these effects are less troublesome with respect to the generation of blue smoke and noisy operation. However, when the engine is warmed up, an advance of the injection timing would result in very loud operation of the engine. Advancing the fuel injection timing is also favorable during engine starting in order to permit a rapid acceleration of the engine. Generally, advancing the fuel injection in a cold engine reduces the amount of visible smoke.

Illustrated Embodiments

Figure 1:
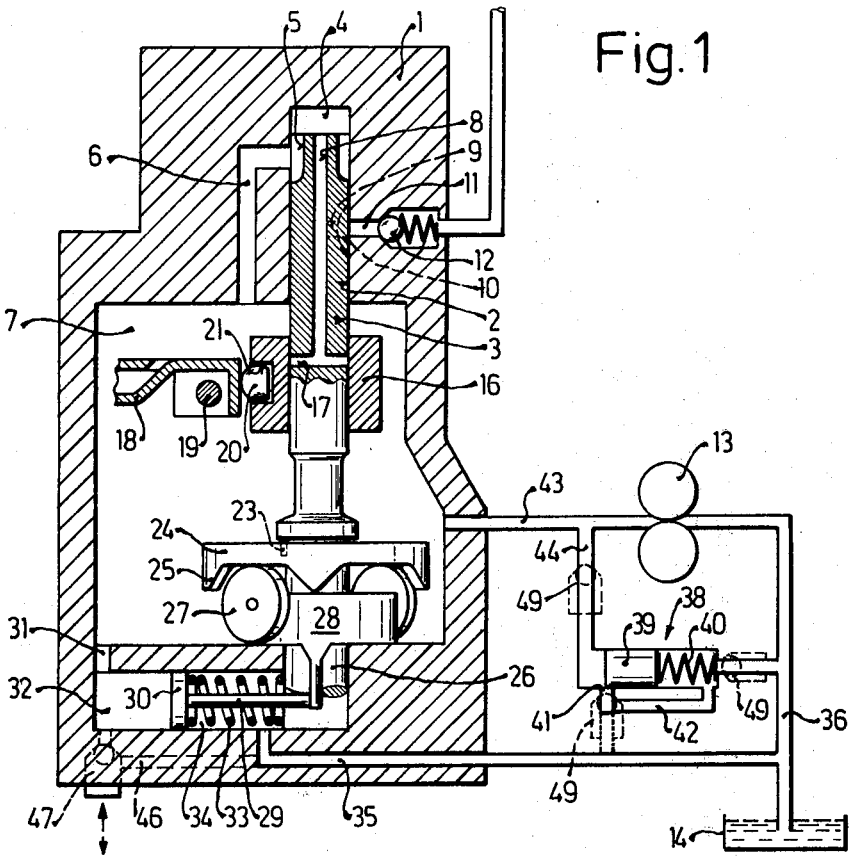
FIG. 1 illustrates schematically a high-pressure fuel injection pump of the type in which the invention is made.

Turning now to FIG. 1, there will be seen a simplified illustration of a high-pressure fuel injection pump according to the invention. A housing 1 includes a cylindrical bore 2 in which a pump piston 3 reciprocates and rotates at the same time. The means for causing this simultaneous movement are not shown. The pressure chamber 4 of the injection pump communicates through axial grooves 5 in the piston and a channel 6 in the housing with a sump 7 which is supplied with fuel by a fuel supply pump 13. After executing a downward suction stroke, the piston is rotated, thereby closing the channel 6 after which the piston assumes its upward stroke, thereby pressurizing the fuel now contained in the pressure chamber 4. During this time, fuel is delivered under high pressure through an axial channel 8 into a radial bore 9 and an axial distribution groove 10 in the periphery of the pump piston. The bore 9 and the groove 10 are shown in dashed lines. The housing contains a plurality of fuel pressure lines 11 which are thus supplied sequentially during the rotation of the pump piston. The number of pressure lines 11 is equal to the number of engine cylinders. Each of the pressure lines 11 may contain a check valve 12 opening in the direction of fuel supply.

The fuel pump 13 takes fuel from a storage container 14 and delivers it to the sump 7. The pump 13 is driven at engine speed or a speed proportional to engine speed and is a volumetric pump whose flow volume increases with speed. The pressure within the sump 7 is controlled by controlling the amount of return flow of fuel in a manner to be discussed in detail below.

Surrounding the pump piston 3 is an annular slide 16 which controls the flow from the axial channel 8 and a radial bore 17 connected thereto with the sump 7. At some point during the upward stroke of the piston 3, the communication between the bore 17 and the sump 7 is established by the annular slide 16, thereby terminating injection and determining the amount of fuel delivered.

The annular slide 16 is displaced on the piston by an intermediate lever 18 which pivots about a pin 19 fixed in the housing. A head 20 engages a recess 21 in the slide 16. The other end of the intermediate lever 18 is engaged by a speed governor, not shown. The lever 18 is further engaged by elastic means whose tension can be changed at will and which oppose the action of the speed governor. In this manner, the amount of fuel which is injected can be changed by changing the position of the annular slide 16 in dependence on engine speed as well as depending on load due to the arbitrarily settable spring tension.

The pressurizing and distributing piston 3 is provided with an indexing pin 23 which insures angular alignment with a disc 24 surrounding it axially and provided with depending cam lobes 25. The disc 24 is positively coupled to a drive shaft 26 that is rotated synchronously with the engine. The cam disc 24 and the cams 25 cooperate with rollers 27 of a roller platform 28 so that when the cam disc 24 and the pump piston rotate, these two elements also execute an axial reciprocating motion. The number of cam lobes 25 corresponds to the number of engine cylinders. The roller support 28 can be rotated with respect to the shaft 26 and the cam plates 24 by a rod 29 which is coupled to an injection timing piston 30. An axial displacement of the piston 30 causes a partial rotation of the roller plate 28. A rotation of the plate 28 shifts the relative angular position of the rollers 27 with respect to the cam lobes 25 and thereby changes the onset of fuel delivery with respect to the instantaneous angle of the drive shaft 26. The injection timing piston 30 is engaged by the pressure of fuel prevailing in the sump 7 and this pressure is transmitted from the sump via a channel 31 into a chamber 32. The pressure impinging on the piston 30 displaces the latter against the force of a return spring 33 to varying extent which, as already discussed, results in a corresponding change of the onset of fuel injection. The chamber 34 which contains the spring 33 communicates via a relief channel 35 with the fuel tank or with the suction line 36 of the fuel supply pump 13.

The change of the pressure in the sump 7 is obtained by controlling the amount of fuel permitted to return from the sump 7 to the fuel supply tank. This controlled return of fuel may be performed in various ways to obtain the desired results. In all cases, however, there will be provided a basic pressure control valve 38 which sets a nominal amount of returned fuel. This pressure control valve 38 includes a piston 39 which is urged by a return spring 40 to move in one direction and which experiences the sump pressure urging it in the opposite direction. The axial motions of the piston 39 result in a variable degree of opening of a drain aperture 41 which communicates through a return line 42 to the suction side 36 of the fuel supply pump 13. The pressure side of the fuel supply pump 13 communicates through a pressure line 43 with the suction sump 7 of the high pressure pump. A branch line 44 is connected between the pressure line 43 and the suction side of the pump to perform pressure control functions.

It is a principle object of the invention to provide a high pressure fuel injection pump in which the onset of injection is advanced by increasing the sump pressure for engine starting and until such time as the engine has warmed up to normal temperature so as to obtain a temporary additional advance of injection. The increase of the pressure in the sump 7 is obtained by reducing the amount of fuel returned through the return conduit to the fuel reservoir. A temporary reduction of the overflow quantity can be obtained in three distinct ways:

1. Pressure in the sump 7 may be reduced by direct engagement of the pressure in control valve 38.

2. The pressure in the sump 7 may be reduced independently of any action taken by the pressure control valve 38 by changing the flow of an additional quantity of fuel through a separately controlled bypass 46, shown dashed in FIG. 1. The exact location of the bypass 46 is not important but it should branch off from somewhere on the suction side of the supply pump 13, which is preferably done as illustrated within the suction sump 7 of the injection pump. A separate pressure control valve 47 controls the flow through the bypass 46.

3. The sump pressure may be controlled by a pressure control valve 49, shown dashed in FIG. 1, and located within the control line 44 or the return conduit 42 and lying in series with the basic pressure control valve 38.

Figure 2:
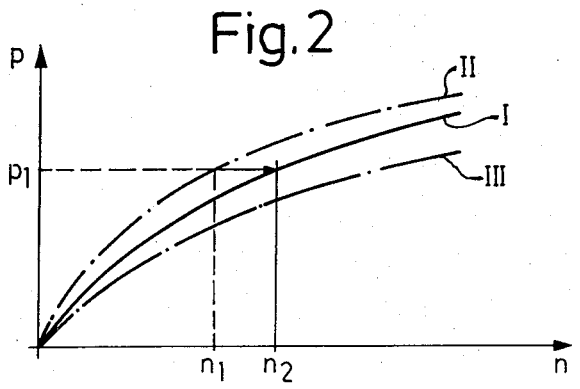
FIG. 2 is a diagram in which the sump pressure of the fuel injection pump is plotted against engine speed.

The effect of changing the pressure within the sump 7 is illustrated in a family of curves in FIG. 2 in which the ordinate "p" indicates the pressure in the sump 7 plotted as a function of engine speed "n". The curve I corresponds to the pressure maintained under normal conditions by the primary pressure control valve 38. According to the stated object of the invention, the pressure in the sump 7 is to be temporarily increased from the time of engine start until normal engine temperatures are attained in order to provide a temporary advance of injection timing. If the curve I is to be regarded as the normal operational curve, the pressure would be increased, substantially corresponding to the curve II. However it is conceivable that the curve I is the curve indicating the increased pressure used during engine starting and that the normally warmed-up engine would operate at a lower pressure, shown for example by the curve III. Several exemplary embodiments are provided for each of these two possibilities. A basic and common principle in all these embodiments is that a decreased flow of returned fuel results in an increase of the pressure in the sump and vice versa.

The FIGS. 3 to 6 illustrate several exemplary embodiments for changing the pressure in the sump 7 by directly engaging the primary fuel control valve 38.

Figure 3:
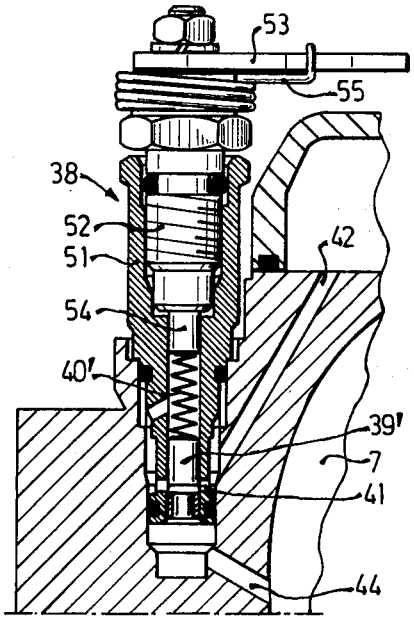
FIGS. 3, 4, 5 and 6 are sectional illustrations of embodiments of a pressure control valve to regulate the return flow of fuel from the sump of the high-pressure pump.

In the first of these embodiments shown in FIG. 3, the pressure in the sump 7 is increased when the engine is cold by changing the tension of a spring 40' which loads a control piston 39' in the pressure control valve 38. The spring tension is changed by a threaded bolt 52 which may be rotated by a lever 53, thereby undergoing an axial displacement whose extent depends on the pitch of the threads, thereby changing the tension of the spring 40'. The fuel flows from the sump 7 through the control conduit 44 beneath the piston 39' and thence through exit orifices 41 into the return line 42. Accordingly, if the plug 52 is advanced into the housing, the pressure in the sump 7 will be increased and vice versa. The lever 53 which rotates the plug 52 is movable against a return spring 55 by any suitable linkage, for example a cable or some other means. It may also be actuated automatically. Normal engine operation, i.e., a fully warmed-up engine, would correspond to a relatively low spring tension and thus to a position of the plug 52 which is relatively far out of the housing. Such a position would correspond to the curve I in FIG. 2. As the engine warms up, the plug 52 is introduced deeper into the housing, thereby increasing the tension of the spring 40' and causing the pressure characteristics plotted in the curve II of FIG. 2.

Figure 4:
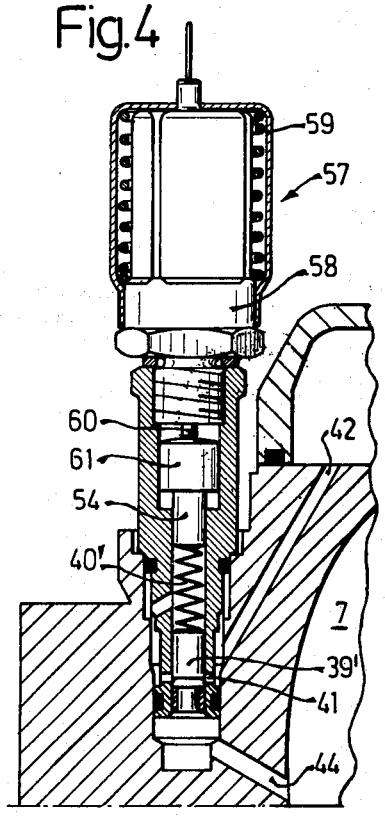

In the exemplary embodiment depicted in FIG. 4, the tension of the spring 40' which loads the piston 54 is adjusted by a temperature-dependent element 57. In the example shown, this temperature-dependent element is an expander cartridge 58 which may be heated by an electrical heater coil 59 and which, when expanding, actuates a pin 60 that pushes an intermediate piston 61 which in turn actuates the primary piston 54. The pressure control valve illustrated in FIG. 4 operates substantially in the same manner as that described with respect to FIG. 3 to alter the amount of fuel permitted to return to the tank.

The temperature-dependent portion of the valve shown in FIG. 4 functions as follows. As soon as the Diesel engine is turned on and the glow plugs are energized, the heating coil 59 is energized at the same time so that the expanding material in the expander plug 58 displaces the pistons 61 and 54, thereby compressing the spring 40' to a greater degree. For this reason, as described above, the pressure in the suction sump 7 rises to that depicted in curve II of FIG. 2, thereby resulting in the desired advance of fuel injection. As soon as the engine has reached operational temperatures, the heating coil 59 is turned off so that the pin 60 returns to its normal retracted state, thereby releasing the tension on the spring 40' and reducing the pressure in the sump 7 to that depicted in the curve I of FIG. 2. The actuation of the heating coil 59 takes place by a preferably temperature-dependent switch.

The temperature-dependent element in the valve 57 may also be actuated by the temperature of the cooling medium of the motor, however in that case the function of its engagement would have to be reversed from that described above. For example, the spring 40' would have to be stressed to a greater degree when the expander element is cold than when it is hot. For example, the pin 60 could rest on a fixed stop while the expander cartridge 58 would move in such a way as to relieve the spring 40'. The tension on the spring 40' may also be changed by a solenoid in the path of its displacement.

Figure 5:
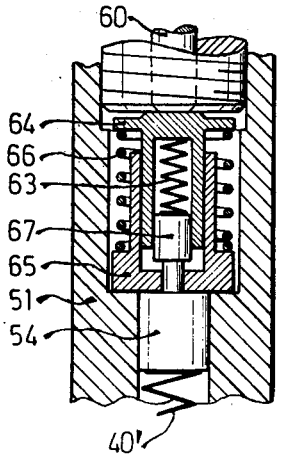

FIG. 5 illustrates a variation of the embodiment shown in FIG. 4 in which the expander element 57 does not act directly on the piston 54 but rather acts first on an intermediate spring 63. The actuating pin 60 is shown in its retracted position and it engages a spring support 64 for the spring 63. The spring support 64 is guided in a bushing 65 supported within the housing 51 and the bushing 65 serves at the same time as a stop for the piston 54 and as a support for a return spring 66 for the pin 60. In the initial position illustrated in FIG. 5, (i.e. a warm engine according to curve I) the spring 63 is substantially relaxed. In any case, it does not tend to displace the piston 54. However when the engine is being started in a cold condition, the heating of the expander causes the pin 60 to move outwardly, thereby compressing the spring 63 and causing the piston 67 to in turn displace the piston 54 and thereby finally causing a change in the pre-tension of the spring 40' and moving the domain of operation to that of curve II.

Figure 6:
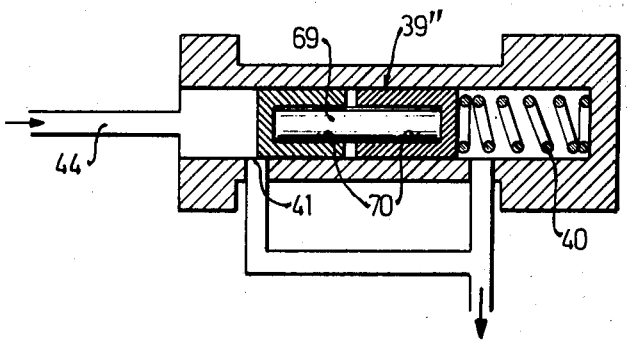

In the exemplary embodiment illustrated in FIG. 6, the piston 39" includes an internal pin 69 whose length depends on temperature. The piston 39" is shown to be divided and provided with internal blind bores 70 which hold the extensible pin 69. As a result, a change in the length of the pin 69 will cause an overall change of the length of the piston 39". The two halves of the piston 39" are pushed onto the extensible pin 69 by the spring 40 and on the other side by the fuel pressure in the line 44. Accordingly, a length change of the pin 69 causes a change in the size of the orifice 41 for the same conditions of fuel pressure, thereby altering the pressure in the suction chamber 7 and hence changing the injection timing.

This type of arrangement which includes an extensible pin 69 can also be used for correcting for the viscosity change of the fuel as a function of temperature. It is known that the viscosity of the fuel decreases with increasing temperatures and this change may be corrected for. In order to have good control of the injection timing during the warm up of the engine, it is assumed that the fuel temperature is at first constant. Furthermore, the fuel temperature does not necessarily change in proportion to the engine temperature. The fuel temperature depends partly on how much heat is lost by the fuel returning from the pressure side to the suction side of the pump, i.e., by the amount of fuel flowing through the pressure control valves being described here. If the extensible pin 69 is properly dimensioned and expands with increasing temperature, it is possible to obtain a temperature-or viscosity-dependent change of the orifice 41 with the result that the control pressure in the sump 7 becomes independent of fuel temperature. However, as already mentioned, the fuel temperature has an effect on the combustion process and it may be desirable to obtain an injection advance when the fuel is cold by increasing the pressure in the suction sump 7. A normally constructed pressure control valve would have an inherent tendency to perform this kind of adjustment due to the changing viscosity of the fuel. However, if it is desired that the pressure increase for cold fuel, then the extensible pin 69 would have to get shorter for increasing temperature.

Figure 7:
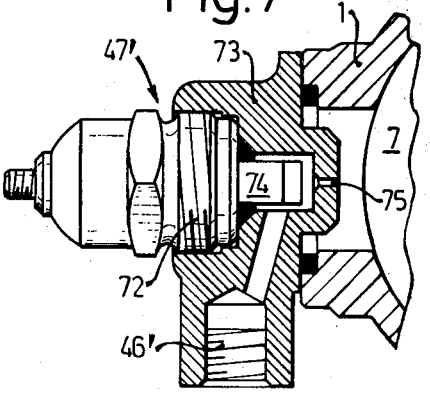
FIGS. 7, 8 and 9 illustrate control valves for adjusting the amount of fuel taken from the sump via a separate drain line.
Figure 8:
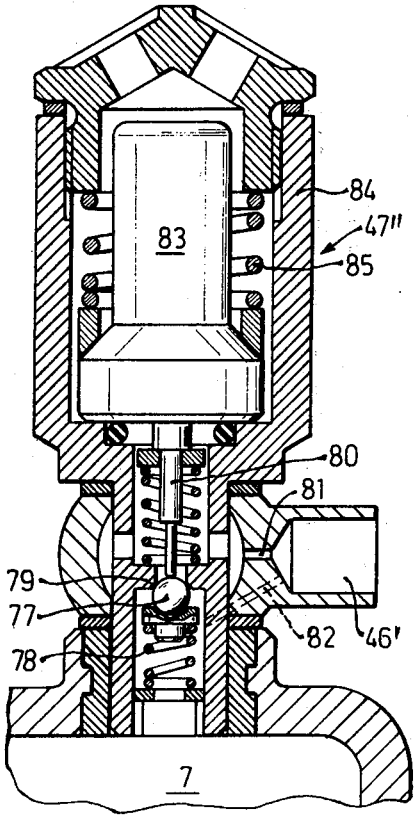
Figure 9:
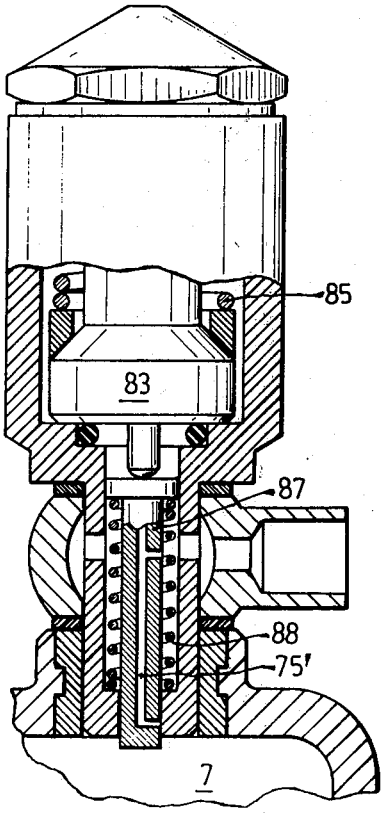

In FIGS. 7–9 there are illustrated exemplary embodiments of a pressure control mechanism which permits fuel to flow back from the sump 7 to the fuel tank via a bypass line 46 and in amounts independent of any which flows through the primary pressure control valve 38. The flow through the bypass 46 is adjusted by a pressure control valve 47. This type of construction brings the advantage that a temperature-dependent pressure control of the type being described here may be added as a separate feature or may even be retrofitted in modular fashion. In order to obtain the above-described advance of fuel injection, the bypass has to be wider for normal operation (warm engine) than it is during warm-up where it may, for example, be completely blocked. The required higher pressure in the sump 7 during starting and warm-up is thus adjusted by the control valve 38 to follow the points on the curve I in FIG. 2. The normal operation will then be effected by the pressure control valve 47 and correspond to the points on the curve III.

In the exemplary embodiment illustrated in FIG. 7, the control valve is basically a solenoid valve 72 which is threaded into a flange 73 mounted on the housing 1 of the injection pump. The armature 74 of the solenoid valve 72 controls the aperture of a throttle bore 75 in the flange 73 through which fuel may flow from the sump 7 to the bypass channel 46 whose initial portion 46' also lies within the flange 73. In FIG. 7, the overflow channel 46' is shown open, i.e., the valve is in the mode corresponding to normal warmed-up engine operation. The solenoid valve may be so constructed as to be energized or unenergized in this condition. In order to switch over to the starting and warm-up phase, the solenoid valve is placed into its opposite electrical state, thereby separating the bypass channel 46' from the throttle 75 and the sump 7 and causing a corresponding increase of the sump pressure and the desired advance of the injection timing. The electrical control of the solenoid valve 72 is preferably effected by a thermoswitch. The flow between the throttle bore 75 and the bypass channel 46' may also be controlled by a thermostatic valve which is heated by a coil or by the engine cooling water, as already described with respect to a previous embodiment. The throttle 75 may also be replaced by a spring-loaded valve member which is adapted dimensionally to the primary pressure control valve 38 and which includes a solenoid or thermostat for opening and closing. The manner in which the movable valve member would be displaced to obtain the pressure control in the sump 7 is similar to that already described with respect to previous embodiments. The important characteristic is that the amount of fuel flowing back through the bypass is changed by selective closure of the bypass or by changing the valve-closing force.

In a further exemplary embodiment illustrated in FIG. 8, a movable valve member 77 is pressed by the prevailing pressure in the sump 7 onto a valve seat 79 and this pressure is enhanced by a spring 78. The movable valve member 77 is also engaged by the pin 80 of the pressure control valve 47'' which tends to move the valve member 77 in the opposite direction urged by the spring 78 and thereby tends to open the valve seat 79 to permit fuel to flow from the sump 7 into the overflow conduits 46'. The amount of fuel which passes through the valve may be determined by the degree of opening of the valve seat 79 or by a throttle aperture 81 disposed within the channel 46'. There may also be provided an additional and constant overflow channel 82 shown in dashed lines. Which and how many of these features are combined is a matter of fine tuning in association with factors deriving from the primary pressure control valve 38 and is subject to experimentation to some degree. The presence of a constant return flow insures a certain amount of pump cooling and also tends to purge air bubbles from the fuel depending on where the bypass 46 terminates in the valve. In the exemplary embodiment shown in FIG. 8, the controlling element is an expander 83 which is located in a housing 84 receiving engine cooling water. If the motor is cold, the pin 80 of the expandable controller 83 remains retracted so that the valve 77, 78, 79 is closed. Accordingly, the pressure in the sump 7 is relatively high, i.e., corresponding to the curve II in FIG. 2. When the engine warms up, the pin 80 gradually moves out and opens the valve so that an additional amount of fuel may flow from the suction sump 7 to the reservoir and the pressure in the sump 7 is thus correspondingly decreased. In order to prevent an excessive movement of the valve-actuating pin 80, for example when the engine overheats, there is provided a spring 85 which permits an overall yielding of the entire expander element 83 to prevent a possible damage to the valve.

An exemplary embodiment which represents a variation of that shown in FIG. 8 is shown in FIG. 9. The previously illustrated ball 77 is replaced by a spool 87 which includes an internal throttling channel 75'. The spool is capable of displacement against the force of a spring 88 and opens the bore 75' permitting fuel to flow out of the sump 7.

Figure 10:
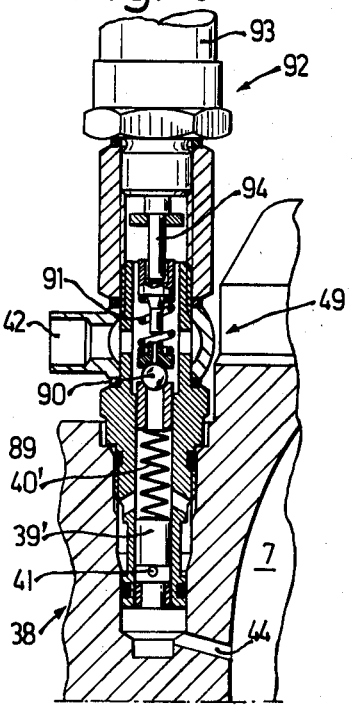
FIGS. 10, 11 and 12 are illustrations of control valves to be placed in series with the main pressure control valve of the pump.
Figure 11:
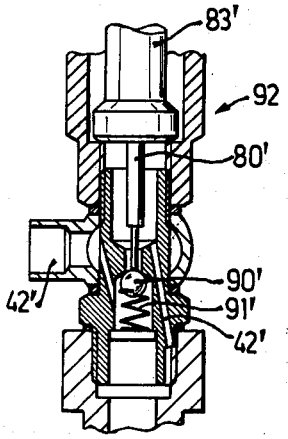
Figure 12:
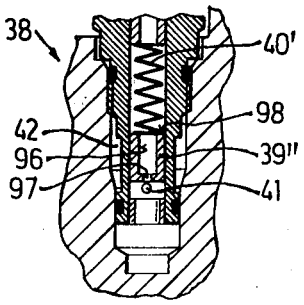

In FIGS. 10–12 there are illustrated embodiments of the third manner of changing the amount of fuel flowing from the sump and hence changing the pressure in the sump 7. This type of control includes a pressure maintenance valve 49 whose fixed holding pressure can be changed and which is located within the hydraulic lines of the primary pressure control valve 38 (see FIG. 1). The increase of the maintenance pressure therefore also results in an increase of the pressure in the sump 7. The pressure maintenance valve 49 may be displaced in the control line 44 upstream of the primary control valve 38 but it may also be placed downstream of the orifice 41 in the return flow channel 42, in which it is preferably the rear face of the piston 39 which is engaged by the pressure maintained by the valve 49. During starting and warm-up, the maintenance pressure of the valve 49 is adjusted to follow the curve II in FIG. 2. During normal operation, i.e., when the engine is warm, the valve 49 is completely shut off or the maintenance pressure is suitably reduced to correspond to the curve I in FIG. 2. None of these changes however affects the basic structure and function of the primary control valve 38.

In the exemplary embodiment illustrated in FIG. 10, the primary control valve 38 and the pressure maintenance valve 39 are combined in the same unit. The construction of the primary control valve 38 is identical to that shown in FIGS. 3, 4 and 5. Fuel flows from the suction sump 7 through the control line 44 to the bottom of the piston 39' of the pressure control valve which is loaded by a spring 40'. In the exemplary embodiments depicted in FIGS. 3–5, the spring 40' had variable tension whereas in the present exemplary embodiment, a pressure maintenance valve assembly 49 is disposed in the path of the fuel flowing out of the spring chamber. The pressure maintenance valve 49 includes a movable valve member 90, illustrated here as a ball which is loaded by a spring 91 of variable tension. When fuel has passed through the overflow orifice 41 in the primary control valve 38, it flows into the return channel 42 which, in this particular embodiment, lies above the spring chamber 89 and passes through the pressure maintenance valve 49. The pressure maintenance valve 49 dams up the fuel to a degree determined by the spring 91 and this additional pressure enhances the pressure exerted by the spring 40' on the primary control valve 38. The tension of the spring 91 in the pressure maintenance valve 49 may be adjusted by a control member 92, for example in dependence on engine temperature. In the exemplary embodiment shown, this control element is an expander 93 which, as already discussed with respect to FIG. 3, may be heated during starting and engine warm-up thereby increasing the force of the spring 91. After the engine has heated up, the heating coil of the expander is de-energized so that its control pin 94 retracts and releases the tension on the spring 91. The release of this tension causes the pressure in the sump 7 to decrease. In this manner, the spring 91 may be unloaded to a degree that the valve 49 has no throttling or flow impedance effects of any kind and the entire pressure control for a warmed-up engine is performed by the primary pressure control valve 38.

A further exemplary embodiment illustrated in FIG. 11 operates in principle in the same way as that illustrated in FIG. 10. The difference is the type of control member 92 which, as in the embodiment of FIG. 8, is surrounded by the engine cooling water so that, after the engine has reached normal temperature, the movable valve member 90' must be relieved. Therefore, the actuating pin 80' of the expander 83' engages the movable valve member 90' and displaces it in opposition to the force of the spring 91'. When the engine is warmed up, the return channel 42' is completely opened and unthrottled so that the pressure control function within the suction chamber 7 is performed entirely by the primary pressure control valve 38. A variant of the previous exemplary embodiment is illustrated in FIG. 12. In this embodiment, the piston 39'' of the primary control valve 38 has a bore 96 with a throttle portion 97. A portion of the returning fuel thus flows through the throttled bore 97 instead of flowing through the main overflow orifice 41. The function of the throttle 97 is to be completely open, as was the case in the throttle 82 of FIG. 8 or a valve, not shown, is disposed downstream of the throttle. In that case, the return channel 42 is divided (in a manner not shown) and the two fuel streams are then brought back together at a later point. If a valve is disposed after the throttle, then the fuel which passes through the throttle bore 97 reaches the pre-chamber of that valve which may be constructed as shown in FIG. 11. This valve would be closed when the engine is cold, resulting in an increase of pressure in the sump 7 and an advance of injection timing. The expander element, which may be heated electrically or by cooling water, gradually opens that valve, thereby lowering the pressure in the suction chamber 7.

It is a general characteristic of automatic control mechanisms that the automatic control loops may open, thereby defeating the desired result and in some cases causing damage to the equipment. For example, in some internal combustion engines, it may be disadvantageous if the injection advance which is desired when the engine is cold is not turned off after the engine has reached normal operating temperatures. If the injection advance were maintained during normal operating temperature, the ignition of fuel would be so far ahead of top dead center as to invite damage to the materials as well as having detrimental effects on the performance of the engine. The failure to reduce the amount of injection advance when the engine is warm may be especially harmful at high engine speeds. On the other hand, as discussed extensively above, an injection advance is very desirable when the engine is cold, especially at low rpm where such an engine is normally operated when it is cold.

Figure 13:
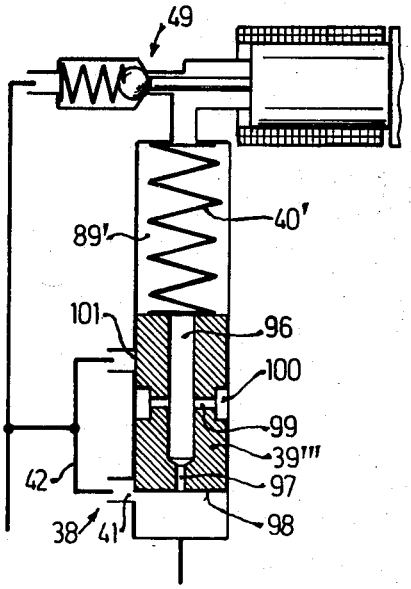
FIG. 13 is a schematic illustration of a control valve which includes an rpm-dependent pressure control.

In order to insure that the injection timing advance is shut off at high engine speeds, there is provided a special embodiment of the primary control valve 38 which permits the pressure to remain at a substantially constant pressure p1 beginning with an engine speed n1 up to an engine speed n2 and thereafter to adjust the pressure to that corresponding to a warmed-up engine. As illustrated in FIG. 2, the pressure thus follows the curve II up to the speed n1 and follows the curve I after the speed n2 is exceeded. In this exemplary embodiment, the piston 39''' of the pressure control valve also has the previously described axial bore 96 and throttle 97. The face 98 of the piston 39''' controls the overflow orifice 41 and the piston 39''' itself is displaceable against the force of the spring 40'. The fuel flow from the spring chamber 89' may be stopped by the pressure maintenance valve 49 but the pressure control may also take place in the manner described in FIGS. 7–9 via a bypass. According to the invention, the control piston 39''' includes a second control feature which opens a second orifice when the critical engine speed n1 is reached. Accordingly, the sum of the opened orifices results in a pressure corresponding to a warmed-up engine. As illustrated in FIG. 13, the bore 96 is connected via a transverse bore 99 with an annular groove 100 in the surface of the piston 39'''. After the piston has been displaced as discussed above, the annular groove 100 opens an overflow channel 101 which terminates in the return line 42. This manner of operation is not limited to embodiment by a piston with a central bore and a communicating transverse bore. The effect may also be obtained by changing, for example, the shape of the control orifice 41 or by providing another piston controlled secondary orifice. The significant aspect of this present embodiment is that, beginning with a definite engine speed, the pressure in the sump is made to correspond to that of a normally warmed-up engine, independently of the actual engine temperature.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. In a fuel injection pump for an internal combustion engine having: a fuel sump; a housing; a working cylinder defined within the housing which receives fuel from the fuel sump; a pump piston mounted for movement within the working cylinder; drive means for effecting the movement of the pump piston; adjusting means including an adjustable piston and restoring force means, said adjustable piston being displaceable against the force of the restoring force means, for adjusting the drive means and thus the movement of the pump piston; a fuel passage leading to the fuel sump; fuel supply means for supplying fuel through the fuel passage to the fuel sump; and pressure control means for controlling the pressure of the fuel supplied by the fuel supply means through the fuel passage, at least in accordance with engine speed and by means of controlling the flow of a partial quantity of fuel back to the fuel supply means, the pressure control means including a movable member and a spring for exerting a closing force against the movable member, the movable member controlling the fuel passage and being subjected to the fuel pressure in the passage, which is exerted against the movable member in opposition to the closing force, the improvement comprising:

a control member; and a heatable thermostat including a working element of expansible material operative at least during engine starting and until engine warm-up, for actuating the control member for controlling the flow of a partial quantity of fuel back to the fuel supply means, wherein:

(i) the control member and the heatable thermostat form part of the pressure control means;

(ii) the closing force exerted by the spring is varied by the control member during the actuation thereof by the heatable thermostat; and (iii) the pressure control means, the control member and the heatable thermostat effect a relative reduction of a total partial quantity of fuel back to the fuel supply means and a corresponding relative increase in the fuel supply pressure in the fuel sump.

2. The fuel injection pump as defined in claim 1, wherein the control member comprises a pressure maintenance valve.

3. The fuel injection pump as defined in claim 2, wherein the pressure maintenance valve is disposed downstream of the pressure control means, wherein said pressure control means comprises a pressure control valve, including said movable member, and a return channel leading back to the fuel supply means, said pressure control valve including means defining a spring chamber within which said spring is mounted, and wherein the return channel communicates through said pressure maintenance valve, with the spring chamber.

4. The fuel injection pump as defined in claim 2, wherein the pressure maintenance valve is disposed downstream of the pressure control means, wherein said pressure control means comprises a pressure control valve including said movable member, means defining a spring chamber within which said spring is mounted, and means defining a bore and a throttle portion, said bore being situated between the throttle portion and the pressure maintenance valve and in communication with the spring chamber.

5. The fuel injection pump as defined in claim 2, wherein said pressure control means further includes a pressure control valve including the movable member, means defining a control orifice, and means defining an overflow channel, and wherein the movable member controls the extent of opening of both the control and the overflow channel.

6. The fuel injection pump as defined in claim 5, wherein the sum of the opening cross sections of the control orifice and the overflow channel corresponds, at least, to the partial quantity during warm engine operation.

7. The fuel injection pump as defined in claim 2, wherein the thermostat is electrically heatable.

8. The fuel injection pump as defined in claim 2, wherein the thermostat is heatable by engine coolant.

9. The fuel injection pump as defined in claim 1, wherein the thermostat is electrically heatable.

10. The fuel injection pump as defined in claim 1, wherein the control member includes an intermediate spring which affects the movable member independently of the spring of the pressure control means, and wherein the spring of the pressure control means acts continuously and the intermediate spring acts during actuation of the heatable thermostat.

11. The fuel injection pump as defined in claim 10, wherein the two springs are disposed in series.

12. The fuel injection pump as defined in claim 10, wherein the control member further includes a piston which engages the spring of the pressure control means, a stop for said piston, a spring support for said intermediate spring, and a return spring situated between the stop and the spring support for biasing the spring support away from the stop.

13. The fuel injection pump as defined in claim 1, wherein the thermostat is heatable by engine coolant.

* * * * *